US006205594B1

(12) United States Patent
Solaberry

(10) Patent No.: US 6,205,594 B1
(45) Date of Patent: Mar. 27, 2001

(54) WATER PRESSURE TOILET PLUNGER

(76) Inventor: Michael D. Solaberry, 10900 W. 56th St., Shawnee, KS (US) 66203

( * ) Notice: Subject to any disclaimer, the term of this patent is extended or adjusted under 35 U.S.C. 154(b) by 0 days.

(21) Appl. No.: 09/476,687

(22) Filed: Dec. 30, 1999

Related U.S. Application Data

(60) Provisional application No. 60/119,120, filed on Feb. 8, 1999.

(51) Int. Cl.[7] ..... E03D 9/00
(52) U.S. Cl. ..... 4/255.04; 4/255.01; 4/255.08
(58) Field of Search ..... 4/255.01, 255.04–255.09

(56) References Cited

U.S. PATENT DOCUMENTS

| | | | | |
|---|---|---|---|---|
| 1,573,202 | * | 2/1926 | Stenwick | 4/255.04 |
| 2,535,092 | * | 12/1950 | Rettinger | 4/255.05 |
| 3,605,135 | * | 9/1971 | Tan | 4/255.01 |
| 3,608,098 | * | 9/1971 | Andrisani | 4/255.04 |
| 4,053,955 | | 10/1977 | Canham | 4/255.03 |
| 4,238,860 | | 12/1980 | Dixon | 4/255.01 |
| 4,768,237 | | 9/1988 | Torti | 4/255.08 |
| 5,239,708 | | 8/1993 | Irwin | 4/255.03 |
| 5,249,311 | * | 10/1993 | Rau | 4/255.05 |
| 5,329,646 | | 7/1994 | Bevacco et al. | 4/255.08 |

OTHER PUBLICATIONS

Master Plunger bellow plunger, sold by G. T. Water Products, Inc., 5239 North Commerce Avenue, Moorpark, CA 93021.

RIDGID/Killmann Telescoping Closet Auger, sold by Ridge Tool Subsidiary, Emerson Electric Co.

*Dr. Leonard's Healthcare Catalogue,* 1999, p. 22.

* cited by examiner

*Primary Examiner*—Henry J. Recla
*Assistant Examiner*—Tuan Nguyen
(74) *Attorney, Agent, or Firm*—Stinson, Mag & Fizzell

(57) ABSTRACT

A toilet clearing device that produces a stream of pressurized water to break up and/or dislodge obstructions in the outlet duct of a toilet. The toilet clearing device is a conduit comprised of an inlet, a flexible section, a rigid handle section, a dislodging extension, and an outlet in fluid flow communication, such that water may be conveyed from the water source, though the device and into the outlet duct of the toilet. The dislodging extension of the device is preferably configured to be inserted into the outlet duct of the toilet. In use, the inlet of the device is attached to a water source, and the user grasps the rigid handle section of the device to direct the dislodging extension of the device toward the obstruction within the outlet duct of the toilet. The pressurized water exiting the device breaks up and/or dislodges the obstruction and pushes it out through the outlet duct of the toilet.

6 Claims, 4 Drawing Sheets

WATER PRESSURE TOILET PLUNGER

CROSS-REFERENCE TO RELATED APPLICATIONS

This application claims the benefit of U.S. Provisional Application No. 60/119,120, filed Feb. 8, 1999.

FIELD OF THE INVENTION

The present invention is generally directed to a plumbing apparatus for unclogging toilets and is more specifically directed to a highly effective, easy to use and sanitary toilet clearing device which utilizes water pressure to break up and/or dislodge obstructions in toilet outlet ducts.

BACKGROUND OF THE INVENTION

Many toilet obstructions are caused in part by the configuration of the waste outlet duct of the toilet, which generally comprises a recessed trap followed by a hump over which waste must travel before exiting the toilet. Toilet paper and other waste particles often build up along the lower surface of the trap because there is insufficient force in the flush of the toilet to move to waste over the hump. This particular type of toilet blockage has increased with the advent of newer water conserving toilets which utilize less water and have less flushing power.

A wide variety of tools have been developed for use in unclogging toilets. Conventional toilet plungers are relatively inexpensive and simple devices that can be maintained in the household for use by a non-professional do-it-yourself plumber. These conventional plungers consist of a deformable suction cup attached to a rigid handle and utilize alternating suction and pressure to dislodge obstructions in the outlet duct of the toilet. In use, the user is required to push the suction cup into sealed engagement with the waste outlet duct of the toilet and then move the handle up and down in an effort to create sufficient suction and pressure to clear the blockage. This can require a significant amount of physical effort by the user and is often difficult for weaker or older individuals. Particularly in smaller toilet closets, it is often difficult for a smaller user to get sufficient leverage to maintain the seal between the plunger and toilet that is needed to create the suction. In addition, use of the plunger often causes water and/or waste to splash outside of the toilet bowl onto the user and the surrounding area.

Another commonly used type of toilet clearing device is known as an auger or snake which comprises an elongated spring having an outer lead end and an inner end coiled within a crank device. Upon actuating the crank, the spring is slowly released from the crank device to lengthen the outer lead end of the spring. In use, the user positions the lead end of the spring just inside the outlet duct of the toilet and uses the crank to push the lead end of the spring past the trap and over the hump. Although this type of device can be useful in alleviating some toilet blockages, the spring is relatively flexible and is merely being pushed along by the remote crank, such that it is difficult to control. As a result, the spring often times passes over the bottom surface of the trap such that the toilet outlet is not fully cleared. These auger-type devices can also be relatively cumbersome and difficult to maneuver, requiring a substantial amount of physical effort for the user to hold the device, direct the spring and turn the crank. These devices are generally more expensive than conventional plungers, are relatively bulky or heavy, and as a result, are difficult to store. Lastly, the lead end of the spring commonly scratches the bottom surface of the toilet bowl adjacent the outlet duct when the spring is initially being pushed forward through the outlet duct, leaving unsightly scratch marks that are difficult, if not impossible, to remove.

Others in the field have suggested using water pressure to dislodge obstructions in drains and toilet outlets. For example, U.S. Pat. No. 4,768,237 discloses a toilet plunger having a conventional suction cup and handle wherein the handle includes a connection for the supply of pressurized water. In use, the suction cup is positioned in sealed engagement with the toilet bowl around the outlet duct, and increased pressure is supplied to the outlet duct via pressurized water. Similarly, U.S. Pat. No. 4,238,860 discloses a drain cleaning device adapted to unclog drains and toilet bowls wherein the device comprises a dome-shaped cup adapted to receive pressurized water and a bulbous plug fitting adapted to be secured within the drain or outlet duct opening so as to seal the opening as water passes through the cup and plug fitting. These water pressure devices heretofore known in the art are generally positioned in a sealing engagement with the outlet duct opening so as to rely on a general build up of pressure between the device and the obstruction to dislodge the obstruction. Because of the configuration of the devices, it is oftentimes difficult for the user to position the devices in this sealing engagement without putting his or hands in the toilet bowl water. Furthermore, if the device is unsuccessful in clearing the obstruction, the pressure build-up will eventually cause the seal between the device and the opening to suddenly break, driving the device backward toward the user and likely disrupting water and waste within the toilet bowl such that it splashes on the user and surrounding area.

Thus, while the devices heretofore known for clearing toilet obstructions are useful, they are often times difficult for non-professional plumbers to effectively use, particularly smaller, elderly or relatively weak individuals. As a result, many of these individuals must call a professional plumber for even relatively minor toilet blockages. Insofar as these types of toilet blockages are occurring more frequently due to the reduced water pressure generated by flushing the newer water conserving toilets, these calls can become very expensive and a true hardship on these individuals. Even for those persons who have the strength and agility to manipulate these prior devices, all of these devices are relatively inconvenient to use and have varying degrees of effectiveness. There is always a risk that water and other waste in the toilet bowl will splash on the user and surrounding area when using a conventional plunger or one of the prior known pressurized water devices. This is not only inconvenient and a nuisance to clean up, but is very unsanitary and poses a risk of harm to the user. The auger devices, on the other hand, are more expensive, create unsightly scratches on the interior of the toilet bowl and are often ineffective in fully clearing waste from the trap.

In view of all of the foregoing, it is a primary object of the present invention to provide a toilet clearing device that alleviates obstructions within the toilet outlet duct in a manner that is relatively convenient and easy for the non-professional plumber.

A related object of the invention is to provide a toilet clearing device that requires little physical effort by the user such that it is easy to use and maneuver even for elderly, small and/or relatively weak individuals.

Another object of the invention is to provide a toilet clearing device that clears obstructions from the toilet outlet without splashing water and/or waste out of the toilet bowl.

Another object of the invention is to provide a toilet cleaning device that is relatively inexpensive, lightweight and can be conveniently stored in the home.

Yet another object of the invention is provide such a toilet clearing device that will not scratch or otherwise damage the toilet.

A further object of the present invention is to provide a toilet clearing device that will break up or dislodge waste material positioned along the lower surface of the toilet trap.

SUMMARY OF THE INVENTION

The present invention is directed to a toilet clearing device that produces a directed stream of pressurized water to break up and/or dislodge obstructions in the outlet duct of a toilet. The device may also be used to directly strike obstructions positioned within the toilet trap to dislodge and free the obstructions from the toilet.

The novel clearing device comprises an elongated open-ended conduit having an inner channel extending therethrough for conveying water from a water source, such as the bathroom sink, to the toilet outlet. The device has a relatively flexible section which extends from the fluid flow inlet to a relatively rigid handle section. The flexible section and rigid handle section are in fluid flow communication and are constructed to enable the user to conveniently hold and maneuver the device and direct the water stream into the toilet outlet duct. A relatively rigid dislodging extension, in fluid flow communication with the rigid handle section, extends from the lower end of the handle to the outlet end and is configured to be inserted into the toilet outlet and directed along the bottom surface of the trap. This dislodging extension is preferably formed of a plastic material such that it can be scraped against the interior of the toilet bowl and outlet duct without scratching the toilet. The diameter of the inner channel through the rigid handle section and dislodging extension is preferably less than the diameter of the inner channel through the flexible section so as to increase the pressure of the water exiting the clearing device. A splash guard may be mounted around the device at the intersection between the handle section and dislodging extension. The guard enables the user to properly position the device within the toilet bowl and prevents water or waste from splashing out of the toilet bowl.

The flexible section of the clearing device is preferably long enough to extend from the bathroom sink to the toilet. The rigid handle section is preferably sufficiently long to enable the user to use the device in a comfortable standing position without requiring the user's hand to contact the water in the toilet bowl. The dislodging extension is preferably sufficiently long to enable the outlet end of the device to reach the rear wall of the toilet trap.

In a preferred embodiment, the toilet clearing device is comprised of a narrow rigid plastic tube inserted partially within the end of a clear flexible hose, such that the portion of the rigid tube positioned within the hose forms the handle section of the device and the portion of the rigid tube extending outside of the hose forms the dislodging extension. The rigid tube is sealed in fluid flow communication within the flexible hose so as to enable a continuous flow of water from the flexible hose though the rigid tube. The inner channel of the rigid tube has a reduced diameter from that of the flexible hose such that the pressure of the water exiting the tube is increased. A tubular connector is secured over the rigid tube to divide the handle section and the dislodging extension and to enable a disk shaped foam splash guard to be secured around the device.

To use the clearing device, the user first attaches the inlet end of the clearing device to a water outlet. The user grasps the upper end of the handle section and positions the dislodging extension of the clearing device within the outlet duct of the toilet. The guard, if present, is positioned against the opening to the toilet outlet duct to assist the user in positioning the dislodging extension of the clearing device within the outlet. The guard also prevents the churning water produced by the clearing device from splashing onto the user or the bathroom floor. The user then turns on the water and adjusts the amount of water to produce the desired amount of water pressure. As water flows through the clearing device and out of the outlet end, the user can direct the water stream at various points within the toilet outlet duct. Further, if the obstruction is close enough to the toilet bowl, the user can use the dislodging extension of the clearing device to directly strike the obstruction until it becomes dislodged.

The novel toilet clearing device of the present invention is lightweight, easy to maneuver and, unlike the conventional plunger, auger and other prior devices, allows the user to direct the high pressure water directly at obstructions, including obstructions that are along the bottom of the toilet trap. The toilet clearing device of the present invention also prevents water splashes associated with other toilet clearing devices by employing the guard and by utilizing a directed stream of water that does not require suction or water pressure build up and will not cause splashing or a sudden back splash of water. Further, the user may control the amount of water pressure by controlling the force of the water coming from the water outlet and may monitor the flow of the water through the clear flexible plastic hose.

DETAILED DESCRIPTION OF THE DRAWINGS AND PREFERRED EMBODIMENTS

Figure 1:
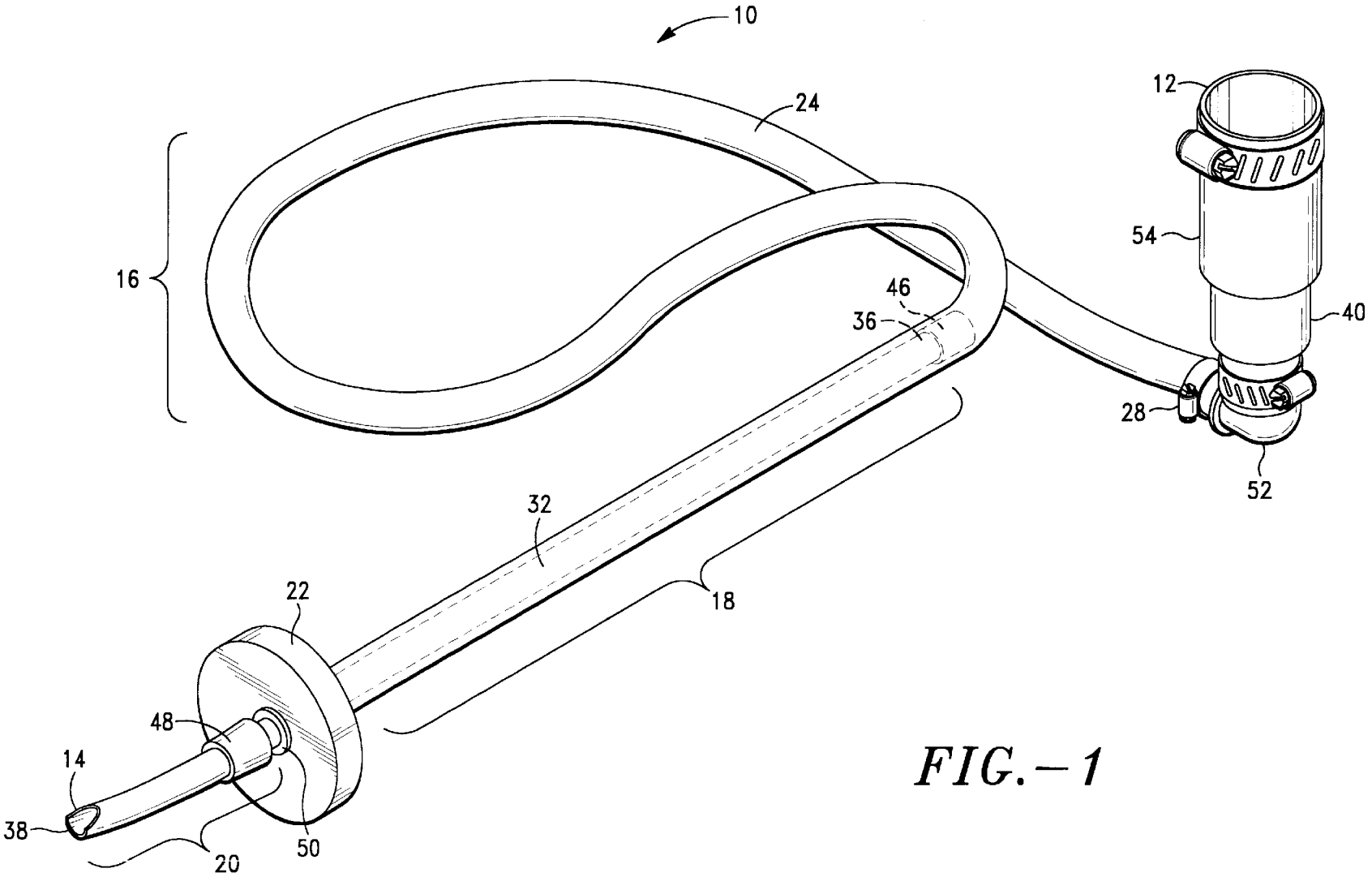
FIG. 1 is a perspective view of a preferred embodiment of the toilet clearing device of the present invention.

Turning to FIG. 1, a toilet clearing device in accordance with the present invention is generally designated by the numeral 10. Clearing device 10 has an open fluid flow inlet 12 adapted for removable attachment to a water faucet or other source of water, and an open outlet 14 through which the water may be directed into the outlet duct of the toilet. The device has a flexible hose section 16 which can be bent and otherwise manipulated to extend from the faucet to the toilet, an elongated rigid handle section 18 which can be held by the user while in a standing position, and a rigid dislodging extension 20 which is slightly curved to be inserted into the outlet duct of the toilet to direct the water flowing out of the outlet end of the device to dislodge the obstruction. Inlet 12, flexible hose section 16, rigid handle section 18, dislodging extension 20 and outlet 14 all possess inner channels which are in fluid flow communication. Guard 22 is mounted at the intersection between the handle section 18 and dislodging extension 20 to assist the user in correctly position dislodging extension 20 proximal outlet 14 within the toilet outlet and to prevent splashing of the water in the toilet bowl.

The overall length of the clearing device 10 may vary, but will typically range from 5 and 12 feet long. Flexible hose section 16 should be of sufficient length to reach from the toilet to the sink in an average bathroom. Preferably, flexible hose section 16 is at least 4 feet long, more preferably is between 5 and 11 feet long, and most preferably is 5 feet long. Rigid handle section 18 is preferably of sufficient length to extend from the mid-section of an average user standing in front of a toilet to the opening of the toilet outlet duct. In this manner, the user can direct dislodging extension 20 of device 10 into the toilet outlet while standing in a comfortable relaxed position and while keeping his or her hands out of the water in the toilet bowl. The handle section 18 is preferably between 1 and 5 feet long, more preferably between 2 and 4 feet long, and most preferably about 3 feet long. Dislodging extension 20 is of sufficient length to extend through the opening of the toilet outlet duct into the trap of the toilet, and preferably ranges from ½ to 6 inches, more preferably 1 to 6 inches and most preferably 2½ to 4 inches. For use in toilets having a conventional trap configuration, the dislodging extension 20 is preferably of sufficient length to extend from the outlet opening to the back wall of the trap.

Figure 2:
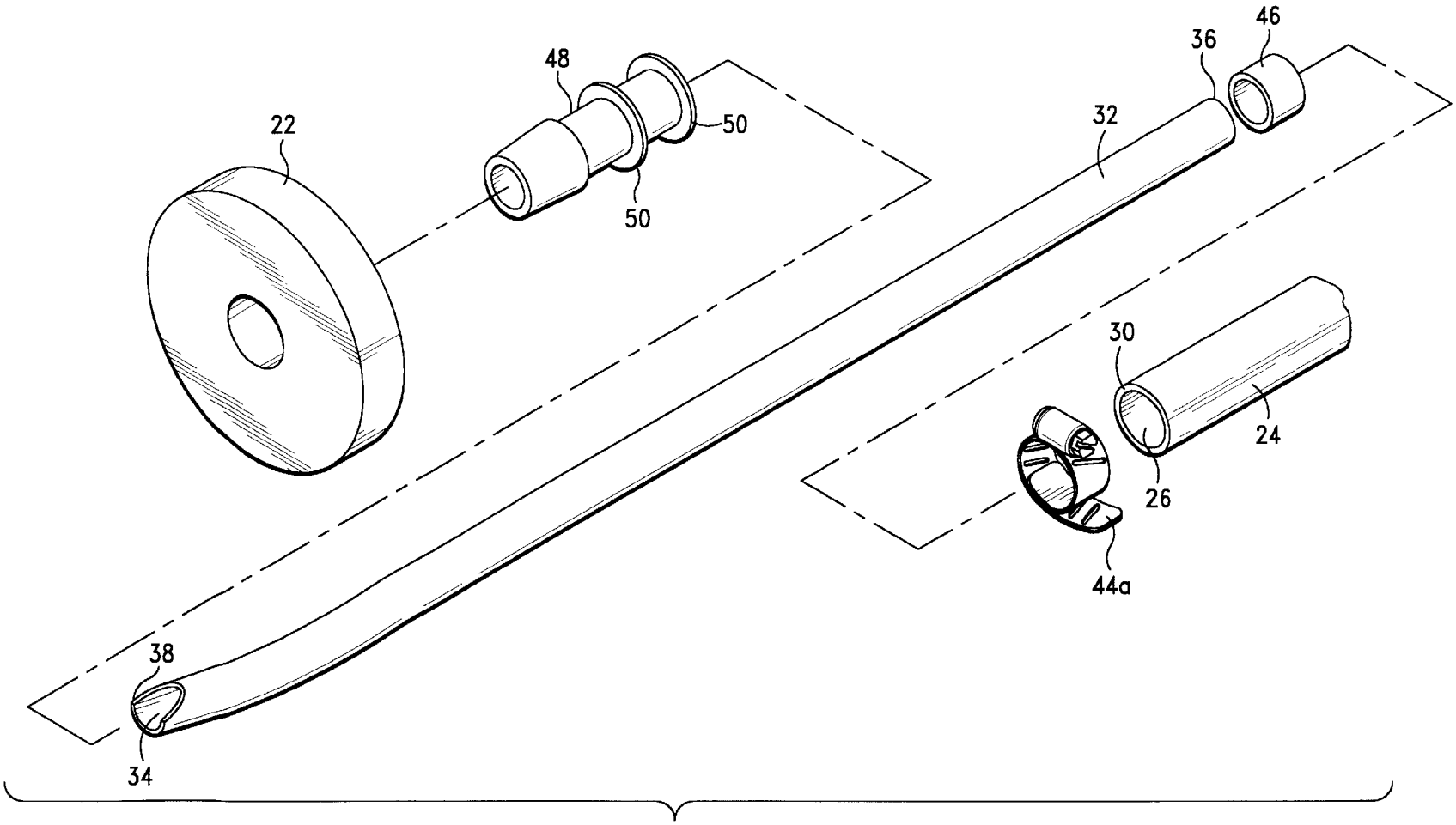
FIG. 2 is a partial exploded view of the toilet clearing device of FIG. 1.

In the preferred embodiment of the invention depicted in FIGS. 1 and 2, the device is constructed of a flexible hose 24 having an inner channel 26 which extends from an open inlet end 28 to a second open 30 end, and a rigid tube 32 having an inner channel 34 that extends from a first open 36 end to an open outlet end 38. The inlet end 28 of flexible hose 24 is secured within a coupling tube 40 which is configured to removably attach to the spout of a water faucet or other water outlet. The first open end 36 of rigid tube 32 is received within the second open end 30 of flexible hose 24, such that a portion of rigid tube 32 is secured within flexible hose 24 thereby forming the handle section 18. The remainder of the rigid tube 32 extending outside of flexible hose 24 forms rigid dislodging extension 20 of the device 10 and the outlet end 38 of the rigid tube 32 also serves as the outlet 14 of device 10.

Rigid tube 32 is preferably comprised of a rigid water-resistant plastic, such as polyvinyl chloride (PVC), although it will be readily recognized by one skilled in the art that a variety of water-resistant rigid materials, including polyvinyls, are compatible with the present invention. Rigid tube 32 has an exterior diameter and interior diameter, with the exterior diameter slightly larger than the interior diameter. The exterior diameter of rigid tube 32 is preferably ⅛ to 1 inch, more preferably ⅛ to ½ inch, and most preferably is ¼ inch and is preferably less than the interior diameter of flexible hose 24.

Figure 4:
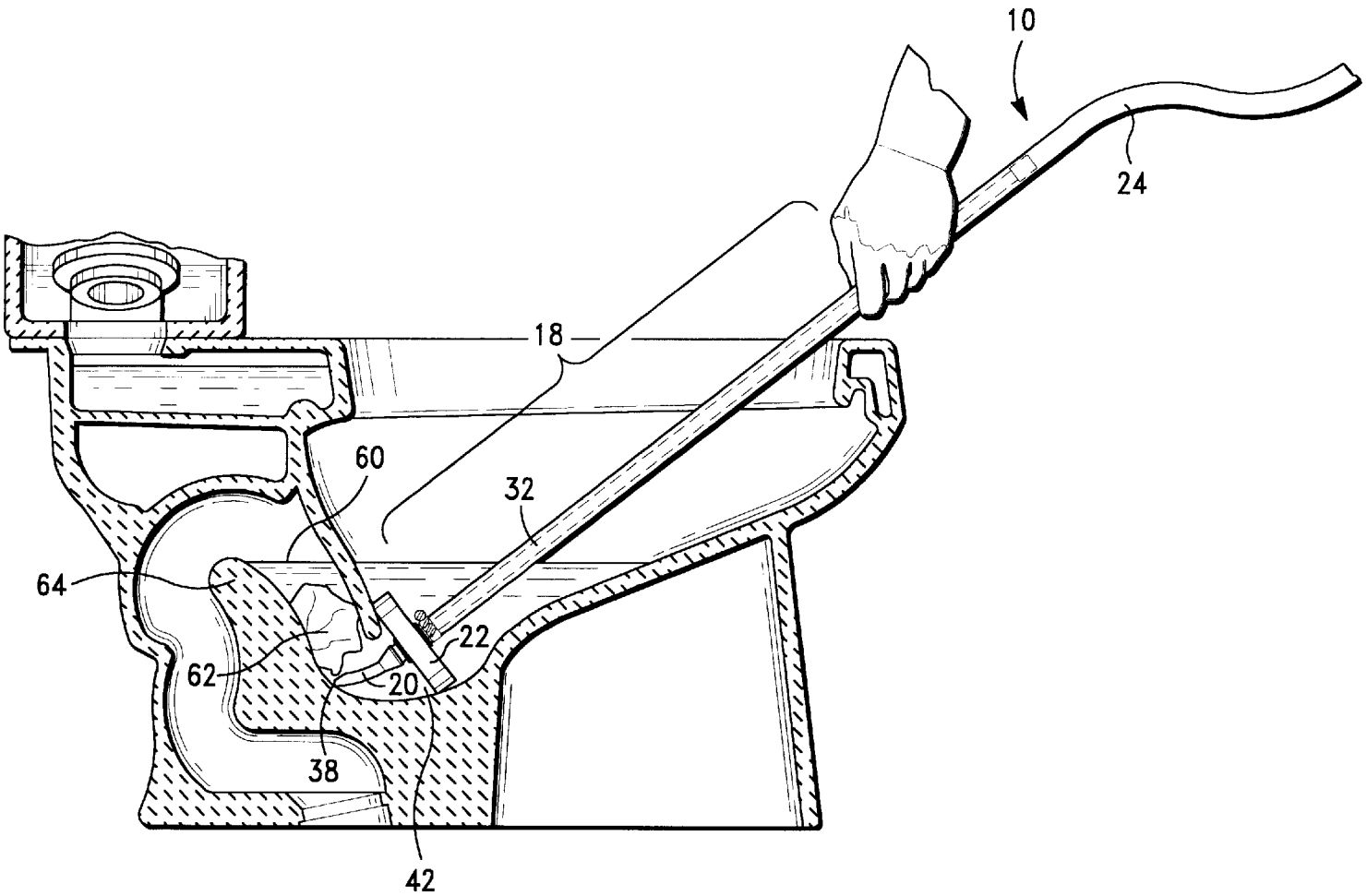
FIG. 4 is side view of the toilet clearing device of FIG. 1 shown in use in a cross-sectional view of a toilet.

In a preferred embodiment of the invention best shown in FIG. 4, that portion of rigid tube 32 forming the dislodging extension 20 of device 10 is slightly curved adjacent outlet end 38 so as to conform to the shape of the outlet duct of the toilet and enable outlet end 38 to be positioned into the outlet duct of the toilet and along the upward sloping back wall of the toilet trap 42. The opening at outlet end 38 is also formed at an angle such that the water will be directed upward along the back wall of the trap 42 to push the waste over the hump of the toilet outlet duct. While this curved shape of dislodging extension 20 is deemed preferable for a conventional shaped toilet trap, it is contemplated that the dislodging extension may be shaped in a different configuration to conform to other types of toilet outlet ducts.

Looking to FIGS. 1 and 2, flexible hose 24 is preferably comprised of a flexible water-resistant plastic, such as flexible polyvinyl chloride (PVC). However, one skilled in the art will recognize that a variety of water-resistant flexible materials, including polyvinyls, are compatible with the present invention. In a preferred embodiment, flexible tube 24 is comprised of a clear plastic, which allows the user to monitor the water flowing within device 10 and to easily identify any leaking or backflow. Flexible hose 24 has an exterior diameter and an interior diameter, with the interior diameter slightly less than the exterior diameter. The exterior diameter of flexible hose 24 is preferably between ¼ and 2 inches, more preferably between ¼ and 1 inch, and most preferably between ½ and ⅝ inch. The interior diameter of flexible hose 24 is greater than the exterior diameter of rigid tube 32 so as to enable rigid tube 32 to be received within flexible hose 24.

Rigid tube 32 is secured in place within flexible hose 24 by clamp 44*a* which is tightly secured around the outer wall of flexible hose 24 adjacent its second end 30. Clamp 44*a* may be made of metal or any known materials with sufficient strength to maintain the affixed relationship between the rigid tube and flexible hose. A spacer ring 46 is secured around the outer wall of rigid tube 32 adjacent its first end 36 to maintain a seal between the interior surface of flexible hose 24 and the exterior surface of rigid tube 32. Spacer ring 46 preferably has a wall thickness equal to the difference between the interior diameter of flexible hose 24 and the exterior diameter of rigid tube 32. In this manner, ring 46 substantially fills the space between the exterior of rigid tube 32 and the interior of flexible hose 24 along a length of the hose equal to the length of spacer ring 46. Spacer ring 46 thereby forms a seal that prevents water from entering the remaining unfilled space between the interior of flexible hose 24 and the exterior of rigid tube 32 to prevent water from leaking out of clearing device 10. Spacer ring 46 is preferably comprised of water-resistant rubber or plastic, although a variety of other materials may be used consistent with the invention.

Guard 22 is mounted around rigid tube 32 adjacent second end 30 of flexible hose 24 so as to divide handle section 18 and dislodging extension 20. Guard 22 is preferably circular in shape, although any shaped guard is consistent with the present invention. Guard 22 is preferably sufficiently large to substantially cover the opening to the outlet duct of the toilet, such that guard 22 can rest against the portion of the toilet surrounding the outlet duct opening. Guard 22 is preferably 2 to 10 inches in diameter, more preferably 3 to 7 inches and most preferably 4 to 6 inches. Although any resilient and water resistant material is consistent with the present invention, guard 22 is preferably comprised of foam or a foamed plastic. Guard 22 is preferably ¼ to 1½ inches thick, more preferably ¼ to ¾ inch, and most preferably ½ inch thick.

As shown in FIGS. 1 and 2, guard 22 is mounted around rigid tube 32 using a connector 48. Connector 48 is preferably a tubular member having a plurality of circumferential retention ridges 50 encircling its exterior diameter. Preferably, the spacing between ridges 50 is slightly greater than the thickness of guard 22 such that guard 22 is securely retained between two of the ridges 50. Connector 48 is mounted on rigid tube 32 proximate the second end 30 of flexible hose 24 and is held in place by form fitting, an adhesive, or any other suitable means known in the art. In a preferred embodiment, connector 48 is comprised of a hard plastic, such as polyvinyl chloride (PVC), although a variety of materials are consistent with the present invention as will be readily understood by those skilled in the art. Although connector 48 is preferably mounted onto rigid tube 32, connector 48 may be formed integrally with rigid tube 32 and may take any form suitable to retain guard 22 in place around rigid tube 32. Further, connector 48 may not be present at all and guard 22 may instead be mounted directly onto rigid tube 32 by any other suitable means know in the art, such as an adhesive, epoxy, or by form fitting.

Figure 3:
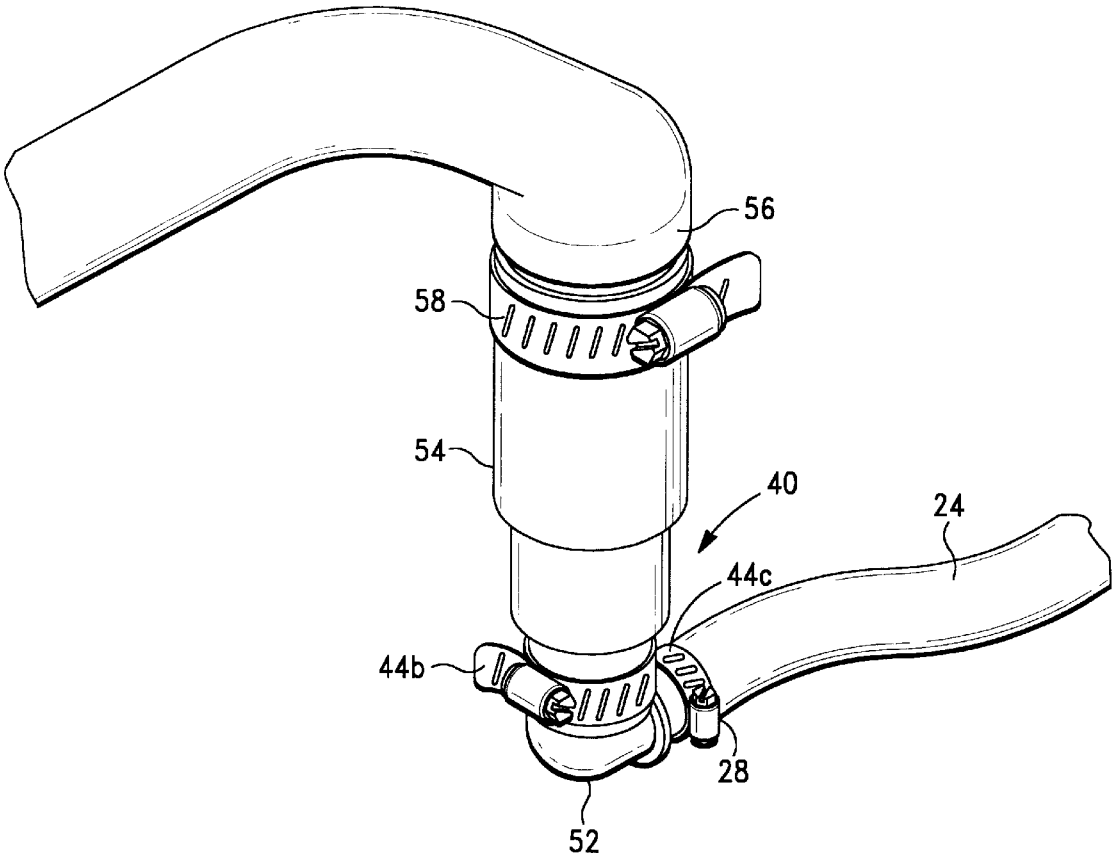
FIG. 3 is a partial perspective view of the toilet clearing device of FIG. 1, depicting the inlet end of the device secured to a water faucet outlet.

Turning to FIG. 3, coupling tube 40 is L-shaped to prevent kinking of flexible hose 24 at the point of connection with the downward facing faucet. Coupling tube 40 comprises an elbow tube 52 having an upper arm received within the bottom end of a rubber connector tube 54. The upper arm of elbow tube 52 is secured in water tight attachment within connector tube 54 by clamp 44*b*. The inlet end 28 of flexible hose 24 is mounted over the forearm of elbow tube 52 and secured in fluid flow communication with the elbow tube by clamp 44*c*.

Coupling tube 40 is configured to be removably secured to a water outlet such as a water faucet by positioning the end of coupling tube 40 around the exterior of the spout 56 and securely attaching coupling tube 40 in place by tightening clamp 58. Coupling tube 40 is preferably somewhat elastic so as to expand to accommodate spout 56 of the water outlet and retain a water tight fit, and is most preferably made from rubber. In most cases, the water outlet will be the faucet of a bathroom sink. Although most faucets have a protruding spout around which coupling tube 40 may be attached, some faucets do not. For such spout-less faucets, a faucet extender and/or aerator can be screwed into or around the faucet opening to provide a protrusion around which coupling tube 40 may be attached. Such faucet extenders and aerators generally comprise a short metal tube having threading around the upper edge to mate with the threading of the faucet. Such extenders are common in the art and readily available at hardware stores. One such aerator is the Spring Flow aerator. Those skilled in the art will readily recognize that similar extension devices are available for most types of water outlets.

Although coupling tube 40 is described with reference to the figures, it should be understood that any devices capable of removable attachment to a water source, such as a water faucet, that will permit fluid flow communication between the water source and the inner channel 26 of flexible hose 24 is considered suitable for purposes of this invention. Furthermore, flexible hose 24 may be fitted directly around or inside spout 56 of the water outlet, without the need for a coupling device. Alternatively, the clearing device 10 may not be connected directly to the water outlet, but may be connected to a hose, which is then connected to the water outlet.

Turning to FIG. 4, to use clearing device 10, the user attaches inlet 12 of clearing device 10 to the water outlet (not shown). The user then grasps clearing device 10 near the upper second end of handle section 18 and positions dislodging extension 20 within outlet duct 60 of the toilet. Guard 22 is positioned against the opening to outlet duct 60 to assist the user in positioning outlet 14 of clearing device 10 within outlet duct 60. As seen in FIG. 4, when guard 22 Is positioned against the opening to outlet duct 60, outlet 14 of clearing device 10 is directed toward the bottom of trap 42 of the toilet where many obstructions occur. Guard 22 also prevents the churning water produced by clearing device 10 from splashing out of outlet duct 60.

The user turns on the water to the desired water pressure and uses handle section 18 to direct the water stream existing outlet 14 toward various points within outlet duct 60. If the obstruction 62 is close enough to the toilet bowl, the user also can direct dislodging extension 20 to mechanically dislodge obstruction 62. Guard 22 can be used as a fulcrum for handle section 18 of clearing device 10 to assist the user in directing the water toward the lower edge of trap 42, where obstructions such as paper commonly are located. In addition, guard 22 limits the distance into trap 42 that clearing device 10 can extend, thereby helping to assure that outlet 14 will not be directed past obstruction 62. The pressurized water exiting outlet end 14 should break up and/or dislodge obstruction 62 and push it over the hump 64 and out of the toilet.

The novel toilet clearing device of the present invention is lightweight and easy to maneuver. The user can direct the high-pressure water directly at obstructions, including obstructions that are along the bottom of the toilet trap. Guard 22 of toilet clearing device of the present invention prevents splashing of toilet bowl water associated with other toilet clearing devices. In addition, toilet clearing device 10 uses a directed stream of pressurized water rather than alternating suction and pressure or a build up of water pressure that may cause splashing or a sudden back splash of water. The user may control the amount of water pressure exiting the device by controlling the force of the water coming from the water outlet, and the clear flexible plastic allows the user to monitor the flow of the water within the device tube for leaks and back flow. Further, because water is being introduced into the toilet by the clearing device, the water level in the toilet will rise as long as the obstruction is blocking the outlet duct. When the obstruction is dislodged, water will be able to again flow through the outlet duct and the water level will stop rising, or fall. Thus, the user will be able to determine when the obstruction is removed, and it is safe to flush the toilet, by watching the change in the water level.

The preferred embodiments described herein are for illustrative purposes only. Numerous changes, modifications, and alterations will be contemplated by those in the art without departing from the spirit and scope of the invention. The scope of the invention is limited only by the appended claims and any modifications within the scope of the claims.

What is claimed is:

1. A toilet clearing device for alleviating obstructions in the outlet duct of a toilet comprising:

a flexible hose extending from an open fluid inlet end to a second open end, wherein said hose has an interior diameter;

a rigid tube extending from a first open inlet end to an open outlet end, wherein said tube has an exterior diameter smaller than said interior diameter of said hose, wherein said first open end of said rigid tube is received within said second open end of said flexible hose, wherein a space is formed between said rigid tube and said flexible hose, wherein a portion of the rigid tube extends outside of the flexible hose to form a rigid dislodging extension configured to be inserted into the outlet duct of the toilet, wherein the rigid dislodging extension is curved adjacent said outlet end so as to conform to the shape of the outlet duct of the toilet, and wherein said rigid tube outlet end is adapted to be in fluid flow communication with said fluid inlet of said flexible hose;

a connector mounted around said rigid tube adjacent said rigid dislodging extension, said connector comprises a plurality of circumferential raised ridges;

a circular guard retained between two of said ridges of said connector;

a spacer ring mounted around said rigid tube inlet end within said space to form a seal between said rigid tube and said flexible hose; and a rigid handle of a sufficient length is formed between said connector and said spacer ring so as to allow a user to direct said dislodging extension into the outlet duct of the toilet while standing.

2. The toilet clearing device as claimed in claim 1, wherein said rigid handle section is between 1 and 5 feet in length.

3. The toilet clearing device as claimed in claim 2, wherein said flexible hose is between 5 and 11 feet in length.

4. The toilet device as claimed in claim 1, wherein said rigid tube is comprised of rigid polyvinyl and said flexible hose is comprised of flexible polyvinyl.

5. The toilet clearing device as claimed in claim 4, wherein said flexible hose is clear.

6. The toilet clearing device as claimed in claim 1, further comprising an L-shaped coupling tube having an adapting end configured to be secured to a water source and a connecting end affixed in fluid flow communication to said inlet end of the flexible hose.

* * * * *